US005182010A

United States Patent [19]

Mochida et al.

[11] Patent Number: 5,182,010

[45] Date of Patent: Jan. 26, 1993

[54] MESOPHASE PITCH FOR USE IN THE MAKING OF CARBON MATERIALS

[75] Inventors: Isao Mochida, Fukuoka; Yukio Sakai; Hiroyuki Ohtsuka, both of Okayama, all of Japan

[73] Assignee: Mitsubishi Gas Chemical Company, Inc., Japan

[21] Appl. No.: 736,561

[22] Filed: Jul. 26, 1991

Related U.S. Application Data

[63] Continuation-in-part of Ser. No. 618,893, Nov. 28, 1990, abandoned.

[30] Foreign Application Priority Data

Nov. 29, 1989 [JP] Japan ..... 1-309482
Oct. 12, 1990 [JP] Japan ..... 2-272300

[51] Int. Cl.[5] ..... C10C 3/00

[52] U.S. Cl. ..... 208/44; 208/39; 208/22

[58] Field of Search ..... 208/44, 22, 39

[56] References Cited

U.S. PATENT DOCUMENTS

| | | | |
|---|---|---|---|
| 4,208,267 | 6/1980 | Diefendorf et al. | 208/22 |
| 4,533,461 | 8/1985 | Izumi et al. | 208/44 |
| 4,655,902 | 4/1987 | Izumi et al. | 208/44 |
| 4,789,455 | 12/1988 | Mochida et al. | 208/39 |
| 4,891,126 | 1/1990 | Mochida et al. | 208/39 |

FOREIGN PATENT DOCUMENTS

| | | |
|---|---|---|
| 054437 | 6/1982 | European Pat. Off. . |
| 318843 | 6/1982 | European Pat. Off. . |
| 58-136835 | 2/1983 | Japan . |
| 58-18421 | 8/1983 | Japan . |
| 2164351 | 3/1986 | United Kingdom . |

OTHER PUBLICATIONS

European Search Report on the instant EP application. English translation of claims of references.

*Primary Examiner*—Paul Lieberman
*Assistant Examiner*—Mary DiNunzio
*Attorney, Agent, or Firm*—Venable, Baetjer, Howard & Civiletti

[57] ABSTRACT

Pitch that is obtained from naphthalene derivatives having at least one methyl group and the content of an optically anisotropic phase in which is substantially 100% is disclosed. This mesophase pitch has a H/C atomic ratio of about 0.5–1.0 and an aromatic carbon ratio (fa) of at least about 0.7, contains methylic carbon in an amount of at least about 4% of the total carbon atoms, and has a softening point of 200°–250° C. The pitch contains about 12–20 mole % of molecules having an average molecular weight of less than about 600, about 55–70 mole % of molecules having an average molecular weight of from about 600–1,500 and about 20–30 mole % of molecules having an average molecular weight of higher than about 1,500. Fibers melt spun from this mesophase pitch can be converted to carbon or graphite fibers having high strength and modulus of elasticity by a heat treatment which consists of heating to a temperature of 200°–350° C. in an air atmosphere, then heating to about 1,000° C. or higher in an inert gas atmosphere. Such mesophase pitch is produced by polymerizing a naphthalene derivative having at least one methyl group for about 5–300 minutes at a temperature of about 180°–400° C. and at a pressure of about 5–100 atmosphere in the presence of about 0.1–20 moles of HF and about 0.05–1.0 mole of $BF_3$ per mole of the naphthalene derivative.

8 Claims, No Drawings

MESOPHASE PITCH FOR USE IN THE MAKING OF CARBON MATERIALS

This application is continuation-in-part application of U.S. Ser. No. 618,893, filed on Nov. 28, 1990, now abandoned.

BACKGROUND OF THE INVENTION

1. Field of the Invention

The present invention relates to mesophase pitch for use in the production of high-performance carbon fibers and other carbon materials.

2. Prior Art

High-performance carbon fibers are commercially produced chiefly from PAN (polyacrylonitrile). However, PAN is expensive and does not show high yield in carbonization. It has recently been found that carbon fibers which have comparable or better characteristics than those prepared from PAN can be produced from inexpensive pitch, and active efforts are being made to commercialize this method.

There are two types of pitch that can be used as a starting material for the manufacture of carbon materials; isotropic pitch and anistropic pitch.

Carbon fibers produced from isotropic pitch are inexpensive but they suffer from the disadvantage of low strength due to poor molecular orientation. Therefore, high-performance carbon products cannot be produced from isotropic pitch. In contrast, carbon fibers produced from anisotropic pitch called "mesophase pitch" have a higher degree of molecular orientation and exhibit improved mechanical properties in terms of strength and modulus of elasticity. Therefore, with a view to producing high-performance carbon fibers, extensive studies are being conducted on the production of mesophase pitch from catalytic cracked petroleum pitch, petroleum tar pitch or coal tar pitch. When fibers are produced by a melt spinning process using mesophase pitch, the developed aromatic planar molecules are brought into alignment with the fiber axis by the shear force exerted as the pitch passes through nozzle holes. This oriented structure is maintained without being disturbed during the stage of subsequent "stabilization" in which the surface of fibers is oxidized by gradual heating under an air current and during the stage of "carbonization" in which the stabilized fibers are heat-treated in an inert gas atmosphere at temperatures not lower than 1,000° C. It has been confirmed by many experiments that this effect contributes to the production of highly oriented, high-performance carbon fibers.

The portion of pitch which has an optically anisotropic phase (this portion is hereinafter referred to as "mesophase") is insoluble in polar solvents such as quinoline and pyridine and it has so far been considered that mesophase is identical to the component which is insoluble in polar solvents. However, later studies have shown that the portion which exhibits anisotropy when observed under a polarizing microscope is not necessarily the same as the insoluble content but that mesophase contains both components which are insoluble and soluble in polar solvents. Therefore, the term "mesophase" as used herein means that portion of a phase which shows optical anisotropy when observed under a polarizing microscope, and the proportion taken by the area of this optically anisotropic phase under observation with a polarizing microscope shall be called "the content of mesophase", or more simply "the mesophase content".

If the mesophase content of pitch is small, the anisotropic phase and isotropic phase in molten pitch will separate to interfere with the spinning operation. Therefore, the mesophase content of pitch is preferably at least 90%, more preferably 100%. However, an increase in the mesophase content generally causes an increase in the softening point and viscosity of the pitch and renders it difficult to perform spinning with consistent results. The high softening point and viscosity necessitate spinning at elevated temperatures but then the pitch is prone to thermal decomposition or condensation, and the resulting gases and infusible high-molecular weight substances make it difficult to continue spinning operations for a prolonged time with consistent results.

Various methods have been proposed for solving these problems with mesophase pitch. U.S. Pat. No. 4,472,265 shows a method in which the mesophase pitch is partially hydrogenated to reduce the degree of stacking of its molecules to an appropriate degree and the resulting "isotropic pitch" is subjected to spinning. Japanese Patent Public Disclosure No. 18421/1983 shows a method characterized by the use of a unique kind of pitch, or "premesophase" pitch which is isotropic during spinning but which turns anisotropic during carbonization. U.S. Pat. No. 4,208,267 shows a method in which isotropic pitch is subjected to solvent extraction, followed by heating the insoluble matter at 230°–400° C. Japanese Patent Public Disclosure No. 136835/1983 shows a method in which isotropic pitch is heat-treated and the resulting mesophase is filtered off, with the remaining pitch being subjected to another heat treatment. U.S. Pat. No. 4,533,461 shows a method in which pitch is heat-treated to adjust the mesophase content to be within the range of 20–80%, followed by precipitation and recovery of the mesophase. U.S. Pat. No. 4,655,902 shows an optically anisotropic carbonaceous pitch that has an average molecular weight of 900–1500, an aromatic carbon fraction (fa) of at least 0.7, a softening point of 230°–320° C. and a content of optically anisotropic phase of 80–100%, and a method of producing such a carbonaceous pitch from specific tar-like materials.

While these methods are improved in one way or another in the use of mesophase pitch, they still have the problems to be described below and completely satisfactory results are yet to be attained by these methods.

In the methods described in U.S. Pat. No. 4,472,265 and Japanese Patent Public Disclosure No. 18421/1983, spinning is performed on isotropic pitch which is not highly oriented, so the molecular orientation in the fibers is not as high as in the fibers spun from anisotropic pitch and the fiber performance is rather low in such aspects as strength and modulus of elasticity. In addition, the method involving the hydrogenation of highly viscous pitch in which the polymerized molecules of a condensed polycyclic aromatic compound are stacked one on another is complicated and is not advantageous for industrial applications.

In the method described in U.S. Pat. No. 4,208,267, only a small amount of the insoluble matter is extracted with a solvent and the yield of mesophase pitch is low. The method described in Japanese Patent Public Disclosure No. 136835/1983 has the disadvantage of complexity in the procedure of filtration to be performed after the heat treatment. The method described in U.S.

Pat. No. 4,533,461 involves technical difficulty in recovering the mesophase and suffers the disadvantage of low yield in carbonization.

In the method described in U.S. Pat. No. 4,655,902, a complicated separation procedure is required in order to obtain an optically anisotropic carbonaceous pitch with a softening point as low as 230°-320° C. The pitch thus produced, however, has a fairly broad molecular weight distribution, which means that the pitch has relatively low homogeneity. Namely, it contains molecules having a molecular weight of up to 600 within the range of from 30 to 60 mole %, molecules having a molecular weight of from 600 to 1500 within the range of from 20 to 50 mole % and molecules having a molecular weight of at least 1500 within the range of from about 15 to 35 mole %.

As already mentioned, the mesophase content of mesophase pitch for use in the production of carbon materials has to be increased in order to provide high performance in such aspects as strength and modulus of elasticity. The mesophase content of the pitch must also be increased for the purpose of facilitating spinning operations in the production of carbon fibers. Additional requirements include high heat stability during spinning operations, high stabilization reactivity of the spun fibers and high yield in carbonization. In the case of producing carbon materials, the yield of the carbon material produced by carbonization of the pitch must also be high.

Therefore, the mesophase pitch for use in the production of carbon materials is required to satisfy the following conditions: (1) high mesophase content, (2) high heat stability during spinning operations, (3) high stabilization reactivity, and (4) high yield in carbonization.

SUMMARY OF THE INVENTION

The present inventors conducted intensive studies in order to develop mesophase pitch having the characteristics described above. As a result, the present inventors found that mesophase pitch that had a reasonable degree of polymerization and a considerably sharp molecular weight distribution, and in which high proportions of the total carbon atoms were occupied by methyl groups and aromatic ring structures exhibited excellent performance. Since this pitch satisfies the four requirements set forth above, it is suitable for use in the production of high-performance carbon products and can be spun into fibers in an easy and consistent way. Furthermore, the spun fibers can be efficiently stabilized with the added advantage of high yield in subsequent carbonization. The present invention has been accomplished on the basis of these findings.

The present invention relates to mesophase pitch for use in the production of carbon materials that has an average molecular weight of at least about 1,000 and the maximum molecular weight of up to about 15,000, that contains about 12 to 20 mole % of molecules having an average molecular weight of less than about 600, about 55 to 70 mole % of molecules having an average molecular weight of from about 600 to 1,500 and about 20 to 30 mole % of molecules having an average molecular weight of higher than about 1,500, that has a hydrogen-to-carbon atomic ratio of about 0.5 to 1.0 and an aromatic carbon ratio of at least about 0.7, with the methylic carbon content being at least about 4% of the total carbon atoms, and that has at least about 90% of an optically anisotropic phase.

The present inventors previously obtained mesophase pitch from a condensed polycyclic hydrocarbon that contained naphthenic carbon in an amount of at least 7% of the total carbon atoms. Since this pitch satisfied the four requirements described above, the inventors filed a patent application on it, which is now U.S. Pat. No. 4,891,126. As a result of their continued studies on mesophase pitch, the present inventors found that when naphthalene derivatives such as methylnaphthalene having at least one methyl group were polymerized, mesophase pitch that contained less than 7% naphthenic carbon atoms and which yet exhibited high performance could be produced. In particular, this mesophase pitch has higher stabilization reactivity than that described in U.S. Pat. No. 4,891,126.

DETAILED DESCRIPTION OF THE INVENTION

The average molecular weight of the mesophase pitch of the present invention is measured with a vapor pressure osmometer using chloroform as a solvent. The solvent-soluble portion of the pitch dissolves in chloroform and its molecular weight is measured with a vapor pressure osmometer. The insoluble portion is made soluble by performing a hydrogenation reaction under mild conditions using metallic lithium and ethylenediamine, and its molecular weight is measured with the same vapor pressure osmometer. The results of the two measurements are used to determine the average molecular weight of the mesophase pitch. The mesophase pitch of the present invention has an average molecular weight of at least about 1,000, preferably about 1,000-1,700, as measured by the above-described method. If the average molecular weight is less than about 1,000, the degree of polymerization that can be achieved is too low to produce pitch having high mesophase content.

The molecular weight distribution of the mesophase pitch of the present invention is measured by fractionating a sample of the pitch into a number of fractions by gel permeation chromatography using chloroform as a solvent, measuring the average molecular weight of each collected fraction with the same vapor pressure osmometer as described above, and preparing a working calibration curve using the average molecular weight thus measured as the molecular weight of a reference material to measure the molecular weight distribution. The maximum molecular weight represents the molecular weight at a point integrated up to 99 weight percent from the low molecular weight side of the molecular weight distribution thus measured. The mesophase pitch of the present invention has a considerably sharp molecular weight distribution as described below and hence, the homogeneity of the pitch is high. Namely, the pitch of the present invention contains about 12 to 20 mole % of molecules having an average molecular weight (M.W.) of less than about 600, about 55 to 70 mole % of molecules having a M.W. of from about 600 to 1,500 and about 20 to 30 mole % of molecules having a M.W. of higher than about 1,500. If the molecules having an average molecular weight of less than about 600 are present in an amount exceeding about 20 mole %, it is difficult for pitch having high mesophase content to be produced in a consistent way. If the molecules having an average molecular weight of higher than about 1,500 are present in an amount exceeding about 30 mole %, the flowability of the resulting pitch is exceedingly low as to render subsequent spinning difficult.

The carbon and hydrogen contents of the mesophase pitch of the present invention are measured with an automatic analyzer (CHN coder) utilizing a detection technique that measures the thermal conductivity of combustion gases. The aromatic carbon ratio (fa) is measured by an IR absorption technique and the methylic carbon content by NMR.

The hydrogen to carbon atomic ratio of the mesophase pitch for use in the production of carbon materials of the present invention is in the range of from about 0.5 to about 1.0, preferably from about 0.6 to about 1.0. If the atomic ratio of hydrogen to carbon is less than about 0.5, the resulting pitch suffers the problem of excessive dehydrogenation compared to polymerization and its softening point is so much increased as to render subsequent spinning and other processing operations difficult. If the hydrogen to carbon atomic ratio is higher than about 1.0, the resulting pitch has a low degree of orientation on account of insufficient degree of polymerization, and this makes it impossible to obtain carbon fibers or other carbon materials having desired performance in such aspects as strength and modulus of elasticity.

The aromatic carbon ratio (fa) is the ratio of the number of carbon atoms in aromatic ring structures to the total number of carbon atoms present. The pitch of the present invention has an fa of at least about 0.7, preferably between about 0.75 and about 0.87. If the value of fa is less than about 0.7, the molecules that constitute a mesophase do not have a high degree of planar structure and it is difficult to achieve consistent production of pitch having a high content of an optically anisotropic phase.

The methylic carbon content of the pitch of the present invention is at least about 4%, preferably at least about 5%, of the total carbon atoms present. If the methylic carbon content is less than about 4%, the stabilization reactivity is so low that it takes an unduly long time to complete the stabilizing treatment, with the increased chance of fusion of occurring between stabilized fibers.

As already mentioned, the optically anisotropic phase (mesophase) of the pitch of the present invention is measured with a polarizing microscope. The pitch of the present invention has a mesophase content of at least about 90%, preferably at least about 95%. More preferably, substantially all part of the pitch is composed of a mesophase. If the pitch has a mesophase content of less than about 90%, carbon fibers or other carbon materials that are formed of it will have only low performance in such aspects as strength and modulus of elasticity. From the spinning viewpoint, too, the mesophase content must be at least about 90%.

The mesophase pitch of the present invention can be produced by polymerization naphthalene derivatives having at least one methyl group in the presence of hydrogen fluoride and boron trifluoride. Illustrative naphthalene derivatives that can be used as the starting material include methylnaphthalene, dimethylnaphthalene and mixtures thereof. Materials containing these naphthalene derivatives are also usable and they include various petroleum fractions, the residual oil originating from petroleum processing steps, and coal tar fractions.

As mentioned above, a hydrogen fluoride/boron trifluoride catalyst is used as a catalyst for polymerizing these naphthalene derivatives. In this regard, particularly suitable starting materials are those which have low contents of nitrogen-, sulfur- and oxygen-containing compounds, all being basic compounds that strongly bind to the hydrogen fluoride/boron trifluoride catalyst. The polymerization catalyst is preferably used in such an amount that from about 0.1 to about 20 moles of hydrogen fluoride and from about 0.05 to about 1.0 mole of boron trifluoride are present per mole of the naphthalene derivative. Even if more than about 20 moles of hydrogen fluoride or more than about 1.0 mole of boron trifluoride is used, there will be no corresponding increase in the rate of reaction. To the contrary, the circulation of the catalyst is increased, leading to the need to employ a large-size reactor. If less than about 0.1 mole of hydrogen fluoride or less than about 0.05 moles of boron trifluoride is used, mesophase pitch with a mesophase content of at least 90% is not attainable. Hydrogen fluoride or boron trifluoride used alone is not effective as a polymerization catalyst, so they must be used in combination in the present invention.

Hydrogen fluoride (HF), when used together with boron trifluoride ($BF_3$), forms a strong protic acid, which reacts with the basic naphthalene derivative to form a complex.

The temperature for obtaining the desired mesophase by polymerization reaction ranges from about 180° to about 400° C., preferably from about 250° to about 320° C. If the temperature is higher than about 400° C., polymerization proceeds excessively and the resulting pitch will have an unduly high softening point. If the temperature is lower than about 180° C., mesophase pitch having a mesophase content of at least 90% is not attainable.

The time required to complete the polymerization reaction varies with the type of starting material used, the temperature and the amount of catalyst used, but it is typically within the range of from about 5 to about 300 minutes, preferably from about 30 to about 240 minutes. The pressure for the polymerization reaction generally ranges from about 5 to about 100 atmospheres, preferably from about 20 to about 50 atmospheres.

The polymerization reaction is performed by mixing under agitation the starting material and the catalyst fed into a corrosion-resistant reactor equipped with a stirrer. The procedures of reaction may be batchwise or continuous.

The naphthalene derivative (Nd) fed as the starting material forms a complex when mixed with the catalyst and undergoes rapid polymerization to form a polymer in complex form according to the following scheme:

$$HF + BF_3 + (Nd)_n \longleftrightarrow H^+(Nd)_nBF_4^- \quad (1)$$

The resulting polymer in complex form is in equilibrium as shown by equation (1), so after completion of the polymerization the volatile components, HF and $BF_3$, are distilled off at the polymerization temperature and recovered as catalyst components. At the same time, some volatile fractions are recovered and the polymerized pitch is separated.

Specific procedures for separating and recovering the catalyst from the pitch are as follows.

Catalyst separation by a batch system consists of holding the polymerization temperature after the polymerization reaction has been completed, and withdrawing HF and $BF_3$ as a vapor phase from the reactor, with the polymer recovered as molten pitch. The heating effected for this purpose may be indirect (external heating through a jacket, etc.) or direct (by introducing the heated vapor of a diluent such as benzene, toluene or halogenated hydrocarbon which are comparatively inert to the catalyst).

Catalyst separation may also be performed by a continuous method in a distillation column, with the inert diluent being refluxed, which is continuously supplied with the polymerization reaction solution so as to extract the HF and $BF_3$ vapors from the top of the column, with the pitch being recovered from the bottom of the column in the form of a solution in the diluent.

Whichever method is used, the temperature necessary for recovering the catalyst is the same as the temperature for polymerization, whereas the pressure for the catalyst recovery is generally within the range of from about 0 to about 30 atmospheres, preferably from about 1 to about 5 atmospheres.

The pitch obtained by the procedure described above is characterized by high mesophase content, high homogeneity and the presence of many carbon atoms in aromatic ring structures as well as in methyl groups. This pitch also has a low softening point which is in the range of 200°-250° C. as measured by a micro-melting point method.

The pitch described above is homogeneous mesophase pitch which is substantially free of HF and $BF_3$ and which has an anisotropic phase of at least about 90%. It can be used as a starting material for the production of carbon fibers and other carbon materials without being subjected to any special treatment. For instance, this mesophase pitch can be readily spun into fibers at a spinning temperature of from about 280° to about 340° C. The spun pitch fibers have such a high stabilization reactivity that they can be satisfactorily stabilized by heating up to a temperature of about 300° C. at a rate of about 7° C./min under an air current. This ease of stabilization can be ascribed to the high content of methyl-derived carbon atoms in the pitch.

Carbon fibers may be produced from the pitch of the present invention by the following procedures: the pitch is first extruded through a nozzle (ca. 0.25 μm) in a nitrogen atmosphere at a pressure of from about 1 to about 3 $kg/cm^2G$ and at a temperature of from about 280° to about 340° C. and the filaments are wound up on a roll at a take-up speed of, say, about 500 m/min; then, the filaments are stabilized by heating from ambient temperature to a temperature between about 200° and about 350° C. at a typical rate of from about 1° to about 7° C./min under an air current; finally, the stabilized fibers are carbonized or graphitized by heating to about 1,000° C. or above at a typical rate of about 10° C./min in an inert gas stream such as nitrogen.

The mesophase pitch of the present invention has the following advantages.

(1) The mesophase pitch of the present invention can be stabilized without employing any complex and costly steps such as filtration of infusible matter at high temperature and solvent extraction thereof. The pitch of the present invention is composed of a substantially homogeneous mesophase and can be spun into carbon fibers at a temperature between about 280° and about 340° C., which is appreciably lower than the conventionally employed temperature range.

(2) The mesophase pitch of the present invention can be spun into fibers at a temperature that is much lower than the point at which marked thermal decomposition or polycondensation occurs (ca. 400° C.). Therefore, the spinnability of the pitch is good enough to resist deterioration during spinning and carbon fibers of consistent quality can be produced.

(3) In the absence of the evolution of any decomposition gases as well as the formation of infusible matter, the pitch of the present invention can be spun at high speed and the spun pitch fibers have so few defects that carbon fibers of high strength can be produced.

(4) The mesophase pitch of the present invention has a high anisotropic phase content of at least about 90%, so carbon fibers produced from this pitch are characterized by well developed orientation in the direction of fiber axis and exhibit high modulus of elasticity.

(5) In spite of this high content of anisotropic phase, the mesophase pitch of the present invention has a high H/C atomic ratio and the proportion of methylic carbon in the total carbon content is high enough to enhance the adaptability of the pitch for stabilization, thereby enabling completely unfusible (stabilized) fibers to be obtained in a shorter period of time.

(6) The mesophase pitch of the present invention ensures high yield in carbonization because of its high degree of polymerization.

For these features (1) to (6), the present invention offers great benefits to industry.

The following examples are provided for the purpose of further illustrating the present invention but are in no way to be taken as limiting.

EXAMPLE 1

α-Methylnaphthalene (1 mole), HF (0.5 moles) and $BF_3$ (0.2 moles) were charged into a 0.5-l acid-resistant autoclave, and after raising the temperature in the autoclave to 270° C., reaction was performed for 4 hours. Thereafter, the release valve on the autoclave was opened so that substantially all of the HF and $BF_3$ charged could be recovered in a gaseous form at an atmospheric pressure. Thereafter, nitrogen was blown into the autoclave to remove the low-boiling point components. The yield of the pitch obtained was 76% of the weight of the α-methylnaphthalene supplied. When observed with a polarizing microscope, this pitch was found to be 100% anisotropic mesophase pitch with a softening point of 240° C., an average molecular weight of 1360, the maximum molecular weight of 8000, a H/C atomic ratio of 0.65, and an aromatic carbon ratio (fa) of 0.82, with the methylic carbon content being 6% of the total carbon atoms. This pitch was comprised of 12 mole % of molecules with an average molecular weight of less than 600, 62 mole % of molecules with an average molecular weight of from 600 to 1500 and 26 mole % of molecules with an average molecular weight of higher than 1500. The naphthenic carbon content of this pitch was 3% of the total carbon. All of these parameters except naphthenic carbon content were measured by the methods described hereinabove. The naphthenic carbon content was measured by an NMR spectrum technique.

This mesophase pitch could be spun into fibers at 310° C. and at a take-up speed of 500 m/min without any fiber being broken during spinning. The fibers could be readily stabilized by heating to 300° C. at a rate of 7° C./min. The stabilized fibers were entirely free from fusion.

The stabilized fibers were heated to 1,000° C. at a rate of 10° C./min in an inert gas atmosphere so as to produce carbon fibers having a diameter of 10 μm. The yield in carbonization was 90%, and the carbon fibers produced had a tensile strength of 280 kgf/mm$^2$ and a modulus of elasticity of 22 tf/mm$^2$.

EXAMPLE 2

A mixture of 60% α-methylnaphthalene and 40% β-methylnaphthalene (7 moles), HF (3 moles) and $BF_3$ (1.0 moles) were charged into a 3-l acid-resistant autoclave, and reaction was performed for 5 hours at a raised temperature of 265° C. By performing subsequent operations as in Example 1, pitch was obtained in a yield of 76 wt % of the mixed methylnaphthalene supplied. When observed with a polarizing microscope, this pitch was found to be 100% anisotropic mesophase pitch. It had a softening point of 212° C., an average molecular weight of 1220, the maximum molecular weight of 6000, a H/C atomic ratio of 0.68, and an fa of 0.81, with the methylic and naphthenic carbon contents being 7% and 4%, respectively, of the total carbon atoms. This pitch was comprised of 16 mole % of molecules with an average molecular weight of less than 600, 59 mole % of molecules with an average molecular weight of from 600 to 1500 and 25 mole % of molecules with an average molecular weight of higher than 1500. All measurements were conducted by the same methods as employed in Example 1.

This mesophase pitch could be spun into fibers at 280° C. and at a take-up speed of 500 m/min without any fiber being broken during spinning. The fibers could be readily stabilized by heating to 280° C. at a rate of 7° C./min. The stabilized fibers were entirely free from fusion.

The stabilized fibers were heated to 1,000° C. at a rate of 10° C./min in an inert gas atmosphere so as to produce carbon fibers having a diameter of 8 μm. The yield in carbonization was 90% and the carbon fibers produced had a tensile strength of 320 kgf/mm$^2$ and a modulus of elasticity of 20 tf/mm$^2$.

EXAMPLE 3

A mixture of 60% 2,6-dimethylnaphthalene and 40% of 1,4-dimethylnaphthalene (7 moles), HF (3.5 moles) and $BF_3$ (1.4 moles) were charged into a 3-l acid-resistant autoclave, and reaction was performed for 4 hours at a raised temperature of 275° C. By performing subsequent operations as in Example 1, pitch was obtained in a yield of 68 wt % of the mixed dimethylnaphthalene supplied. When observed with a polarizing microscope, this pitch was found to be 100% anisotropic mesophase pitch. It had a softening point of 230° C., an average molecular weight of 1330, the maximum molecular weight of 7000, a H/C atomic ratio of 0.70, and an fa of 0.80, with the methylic and naphthenic carbon contents being 9% and 3%, respectively, of the total carbon atoms. This pitch was comprised of 13 mole % of molecules with an average molecular weight of less than 600, 60 mole % of molecules with an average molecular weight of from 600 to 1500 and 27 mole % of molecules with an average molecular weight of higher than 1500.

This mesophase pitch could be spun into fibers at 310° C. and at a take-up speed of 500 m/min without any fiber being broken during spinning. The fibers could be readily stabilized by heating to 270° C. at a rate of 7° C./min. The stabilized fibers were entirely free from fusion.

The stabilized fibers were heated to 1,000° C. at a rate of 10° C./min in an inert gas atmosphere so as to produce carbon fibers having a diameter of 10 μm. The yield in carbonization was 90%, and the carbon fibers produced had a tensile strength of 290 kgf/mm$^2$ and a modulus of elasticity of 23 tf/mm$^2$.

COMPARATIVE EXAMPLE 1

α-Methylnaphthalene (1 mole), HF (3 moles) and $BF_3$ (0.5 moles) were charged into a 3-l acid-resistant autoclave, and reaction was performed for 3 hours at a raised temperature of 80° C. Thereafter, the release valve on the autoclave was opened and gradual heating to 180°-200° C. was conducted at one atmosphere so that substantially all of the HF and $BF_3$ charged could be recovered in a gaseous form. Thereafter, the pitch in molten state was withdrawn from the autoclave. This pitch had a softening point of 72° C. and contained no mesophase. It had an average molecular weight of 900 and the maximum molecular weight of 5000, and was comprised of 50 mole % of molecules with an average molecular weight of less than 600, 40 mole % of molecules with an average molecular weight of from 600 to 1500 and 10 mole % of molecules with an average molecular weight of higher than 1500.

This pitch was heat-treated first at 475° C. for 50 minutes under one atmosphere, then at 420° C. for 30 minutes under a reduced pressure of 100 Torr, thereby obtaining 100% mesophase pitch (softening point, 250° C.) in a yield of 50% based on α-methylnaphthalene.

The resulting mesophase pitch had an average molecular weight of 900, a H/C atomic ratio of 0.51, and an fa of 0.93, with the methylic and naphthenic carbon contents being 2% and 6%, respectively, of the total carbon atoms. This pitch could be spun into fibers at a take-up speed of 300 m/min and at 360° C. but not at a higher take-up speed of 500 m/min. The pitch fibers obtained by spinning at a take-up speed of 300 m/min could not be stabilized by heating up to 270° C. at a rate of 5° C./min.

In this comparative example, α-methylnaphthalene was polymerized in the presence of a HF/$BF_3$ catalyst and the resulting pitch was converted to mesophase pitch by subsequent heat treatments. However, it turned out that this pitch was not suitable for high-speed spinning and stabilization when it was low in average molecular weight and methylic carbon content.

What is claimed is:

1. Mesophase pitch for use in the production of carbon materials that has an average molecular weight of at least about 1,000 and the maximum molecular weight of up to about 15,000, that contains about 12 to 20 mole % of molecules having an average molecular weight of less than about 600, about 55 to 70 mole % of molecules having an average molecular weight of from about 600 to 1,500 and about 20 to 30 mole % of molecules having an average molecular weight of higher than about 1,500, that has a hydrogen-to-carbon atomic ratio of about 0.5 to 1.0 and an aromatic carbon ratio of at least about 0.7 with the methylic carbon content being at least about 4% of the total carbon atoms, and that has at least about 90% of an optically anisotropic phase.

2. Mesophase pitch according to claim 1 wherein the average molecular weight is in the range of from about 1,000–1,700.

3. Mesophase pitch according to claim 1 wherein the hydrogen-to-carbon atomic ratio is in the range of from about 0.6–1.0.

4. Mesophase pitch according to claim 1 wherein the aromatic carbon ratio is in the range of about 0.75–0.87.

5. Mesophase pitch according to claim 1 wherein the methylic carbon content is at least about 5% of the total carbon atoms.

6. Mesophase pitch according to claim 1 which has a softening point in the range of from 200°-250° C.

7. Mesophase pitch according to any one of the preceding claims which contains at least about 95% of an optically anisotropic phase.

8. Mesophase pitch according to claim 7 wherein the content of an optically anisotropic phase is substantially 100%.

* * * * *